US006070676A

United States Patent [19]

Nelson et al.

[11] Patent Number: 6,070,676

[45] Date of Patent: Jun. 6, 2000

[54] DUAL LOCATION HANDLE AND TRIGGER FOR A HAND-HELD POWER TOOL

[75] Inventors: H. Thomas Nelson, Bedford, N.H.; Del S. Schultz, Erin, Wis.; Raymond G. Lavoie, Manchester; Gordon L. Steltzer, New Boston, both of N.H.

[73] Assignee: Framatome Connectors International, Paris, France

[21] Appl. No.: 09/133,638

[22] Filed: Aug. 13, 1998

[51] Int. Cl.[7] ..... B26B 7/00

[52] U.S. Cl. ..... 173/170

[58] Field of Search ..... 173/170, 169, 173/162.2; 16/116 R; 227/132

[56] References Cited

U.S. PATENT DOCUMENTS

| | | | |
|---|---|---|---|
| 1,019,213 | 3/1912 | Adams | 173/170 |
| 1,808,481 | 6/1931 | Slater | 173/170 |
| 2,423,257 | 7/1947 | Schott et al. | 173/170 |
| 3,003,773 | 10/1961 | Fuehrer | 173/170 |
| 3,343,613 | 9/1967 | Carnesecca, Jr. et al. | 173/170 |
| 4,912,848 | 4/1990 | Bidanset | 30/383 |
| 5,546,749 | 8/1996 | Couchee | 173/170 |
| 5,867,910 | 2/1999 | Stegall et al. | 173/170 |

*Primary Examiner*—Scott A. Smith

*Attorney, Agent, or Firm*—Perman & Green, LLP

[57] ABSTRACT

An operating handle system for a hand-held power tool comprises an operating handle including first and second courses enabling it to be gripped in first and second orientations, respectively. A trigger is movably attached to the operating handle for movement between an operative position for energizing a motor for driving an operating element such as a grinding wheel and an inoperative position at which the motor is de-energized. The trigger includes a first portion associated with the first course and spaced therefrom when the trigger is in the inoperative position and contiguous therewith when in the operative position. The trigger includes a second portion associated with the second course when the trigger is in the inoperative position and contiguous therewith when in the operative position. The first and second courses are mutually perpendicular as are the first and second portions. The trigger is pivotally attached to the operating handle such that when the trigger is in the inoperative position, the first portion and the first course are angularly disposed and the second portion and the second course are angularly disposed, and such that when the trigger is in the operative position, the first portion and the first course are contiguous, and the second portion and the second course are contiguous. The operating handle is generally U-shaped including a third course projecting from the second course at a location distant from the first course and being generally parallel to the first course.

2 Claims, 3 Drawing Sheets

DUAL LOCATION HANDLE AND TRIGGER FOR A HAND-HELD POWER TOOL

BACKGROUND OF THE INVENTION

1. Field of the Invention

The present invention relates generally to power tools and, more particularly, to power tools which are capable of being held and operated in more than one orientation.

2. Description of the Prior Art

Over the years, there have been continuing, and generally successful, efforts to improve the ease of operation of power tools and to make them ever lighter while maintaining and improving their capability. Nevertheless, there are no known instances of such efforts enabling the use of a power tool capable of use in different orientations while providing the same ease of operation in each orientation.

Typical of the prior art is U.S. Pat. No. 4,912,848 to Bidanset which discloses a handle for a chain saw comprising a first U-shaped member and a second U-shaped member. The two members are connected to each other. The first member is connected to a bottom of a chain saw and the second member has a side bar that is connected to the body of the chain saw. The two members provide a handle that completely encircles the body of the chain saw to form a structurally rigid dosed loop having multiple grasping positions which is said to be relatively easy to assemble with the chain saw.

It was with knowledge of the foregoing state of the technology that the present invention has been conceived and is now reduced to practice.

SUMMARY OF THE INVENTION

The present invention therefore discloses an operating handle system for a hand-held power tool which comprises an operating handle including first and second courses enabling it to be gripped in first and second orientations, respectively. A trigger is movably attached to the operating handle for movement between an operative position for energizing a motor for driving an operating element such as a grinding wheel and an inoperative position at which the motor is de-energized. The trigger includes a first portion associated with the first course and spaced therefrom when the trigger is in the inoperative position and contiguous therewith when in the operative position. The trigger includes a second portion associated with the second course when the trigger is in the inoperative position and contiguous therewith when in the operative position. The first and second courses are mutually perpendicular as are the first and second portions. The trigger is pivotally attached to the operating handle such that when the trigger is in the inoperative position, the first portion and the first course are angularly disposed and the second portion and the second course are angularly disposed, and such that when the trigger is in the operative position, the first portion and the first course are contiguous, and the second portion and the second course are contiguous. The operating handle is generally U-shaped including a third course projecting from the second course at a location distant from the first course and being generally parallel to the first course.

A primary feature, then, of the present invention is the provision of a power tool with a unique handle system by reason of which it is capable of being held and operated in more than one orientation.

Another feature of the present invention is the provision of such a handle system which assures the same ease of operation in each orientation in which it is held.

A further feature of the present invention is the provision of such a handle system in which the tool geometry is such that the operator can easily operate a work element such as a grinding wheel in either a horizontal, or first, position or in a vertical, or second, position and that the trigger can be actuated from either the first or the second position.

Still another feature of the present invention is the provision of such a handle system which comprises an operating handle including a first course for gripping the operating handle in a first orientation and a second course for gripping the operating handle in a second orientation, a trigger movably attached to the operating handle for movement between an operative position for energizing a motor for driving an operating element and an inoperative position at which the motor is de-energized, the trigger being elongated and including a first portion associated with the first course and spaced therefrom when the trigger is in the inoperative position and contiguous therewith when the trigger is in the operative position and including a second portion associated with the second course and spaced therefrom when said trigger is in the inoperative position and contiguous therewith when the trigger is in the operative position.

Yet another feature of the present invention is the provision of such an operating handle system wherein the first course is substantially perpendicular to the second course and wherein the first portion is substantially perpendicular to the second portion and means pivotally attaching the trigger to the operating handle such that when the trigger is in the inoperative position, the first portion and the first course are angularly disposed and the second portion and the second course are angularly disposed, and such that when said trigger is in the operative position, the first portion and the first course are contiguous with one another, and the second portion and the second course are contiguous with one another.

Still a further feature of the present invention is the provision of such an operating handle system wherein the operating handle is generally U-shaped including a third course projecting from said second course at a location distant from the first course and being generally parallel to the first course.

Yet a further feature of the present invention is the provision of such an operating handle system wherein the trigger extends to a terminal end distant from the pivotally attaching means and wherein the third course has a cavity formed therein for freely receiving the terminal end therein.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
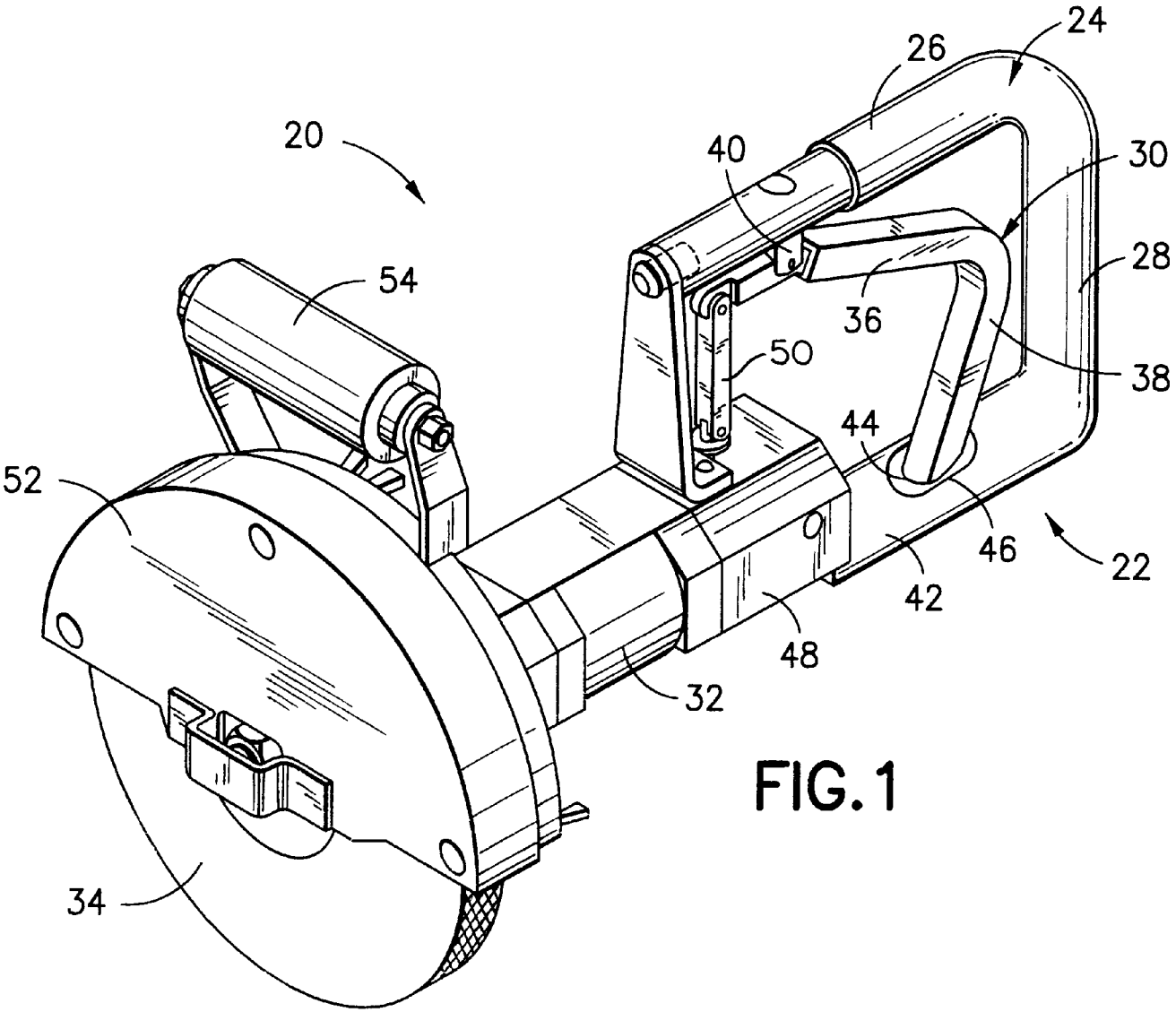
FIG. 1 is a perspective view of a hand-held power tool including an operating handle system embodying the invention.
Figure 2:
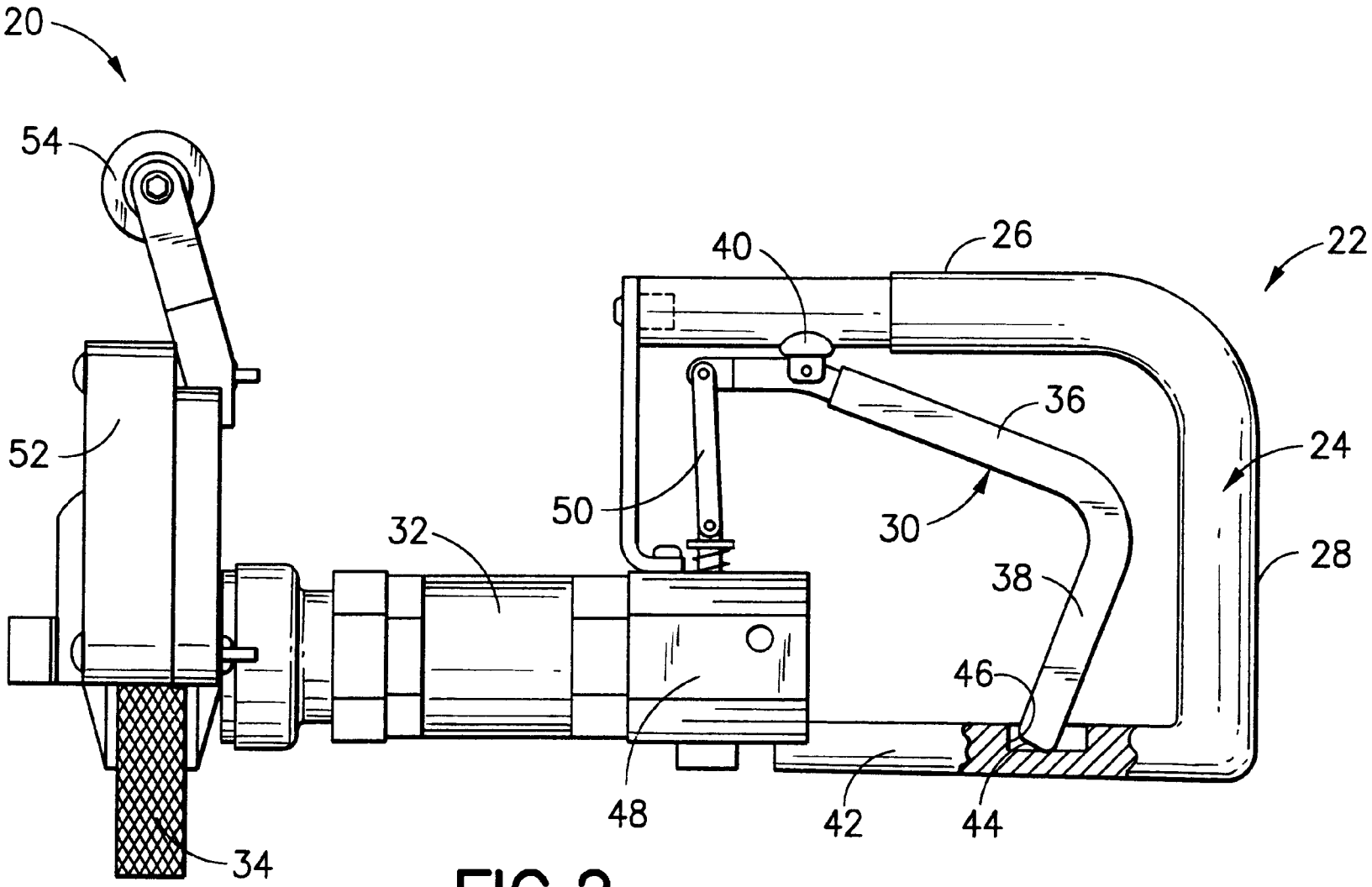
FIG. 2 is a side elevation view of the hand-held power tool illustrated in FIG. 1.

Turn now to the drawings and, initially, to FIGS. 1 and 2 which generally illustrate a hand-held power tool 20 incorporating an operating handle system 22 embodying the invention. To this end, an operating handle 24 includes a first course 26 for gripping the operating handle in a first orientation (see FIG. 3) and a second course 28 for gripping the operating handle in a second orientation (see FIG. 4).

A trigger 30 is movably attached to the operating handle 24 for movement between an operative position (see dashed lines in FIGS. 3 and 4) for energizing a motor 32 for driving an operating element 34 and an inoperative position (see solid lines in FIGS. 3 and 4) at which the motor is de-energized. In this instance, the operating element is illustrated as a grinding wheel but the invention is not to be so limited. The trigger 30 is elongated and includes a first portion 36 associated with the first course 26 of the operating handle 24 . The first portion 36 is spaced from the first course 26 when the trigger is in the inoperative position and is contiguous with the first course when the trigger is in the operative position. The trigger 30 also includes a second portion 38 associated with the second course 28 of the operating handle 24 and spaced from the operating handle when the trigger is in the inoperative (see solid lines in FIGS. 3 and 4) position and contiguous with the second course when the trigger is in the operative position (see dashed lines in FIGS. 3 and 4).

With this construction, an operator holding the first course 26 of the operating handle 24 while simultaneously gripping the first portion 36 of the trigger 30 and drawing it to a position contiguous with the first course 26 (see dashed lines in FIGS. 3 and 4) can thereby energize the motor 32 for driving the operating element 34. Alternatively, an operator holding the second course 28 of the operating handle while simultaneously gripping the second portion 38 and drawing it to a position contiguous with the second course (see dashed lines in FIGS. 3 and 4) can thereby energize the motor 32 for driving the operating element 34.

In a preferred construction, the first course 26 is substantially perpendicular to the second course 28 and, similarly, the first portion 36 is substantially perpendicular to the second portion 38. A suitable joint 40 pivotally attaches the trigger 30 to the operating handle such that when the trigger is in the inoperative position (see solid lines in FIGS. 3 and 4), the first portion 36 and the first course are angularly disposed and said second portion and said second course are angularly disposed, and such that when the trigger is in the operative position (see dashed lines in FIGS. 3 and 4), the first portion and the first course are contiguous with one another, and the second portion and the second course are contiguous with one another. Additionally, the operating handle 24 is generally U-shaped including a third course 42 projecting from the second course 28 at a location distant from the first course 26 and being generally parallel to the first course.

Figure 3:
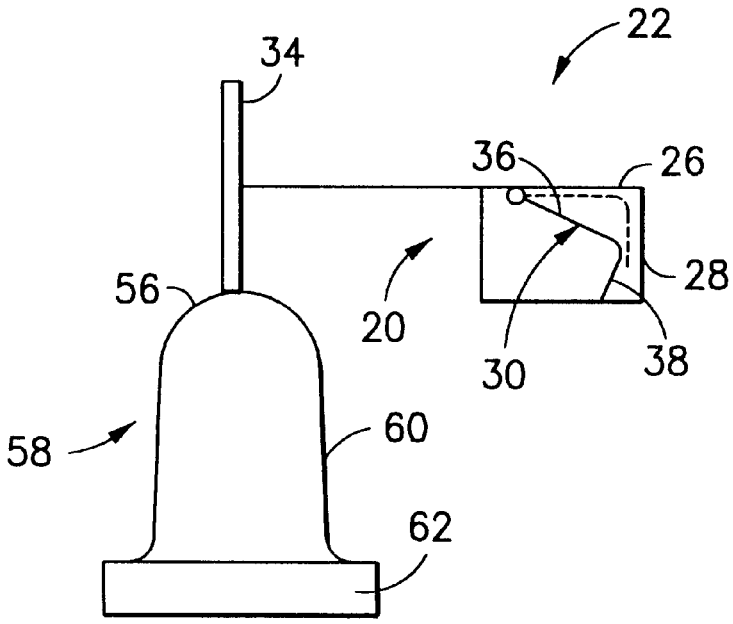
FIG. 3 is a diagrammatic view illustrating the use of the hand-held power tool of FIGS. 1 and 2 while held in one orientation.
Figure 4:
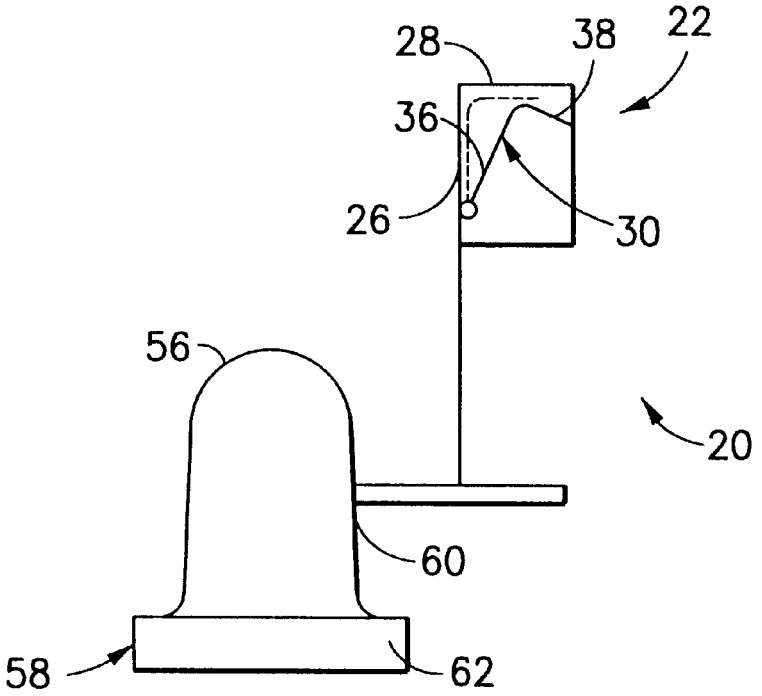
FIG. 4 is a diagrammatic view illustrating the use of the hand-held power tool of FIGS. 1 and 2 while held in another orientation different from that illustrated in FIG. 3.

Also, as clearly seen in FIGS. 3 and 4, the trigger 30 extends to a terminal end 44 distant from the joint 40 and, to accommodate the length of the second portion 38, the third course 42 is formed with a cavity 46 for freely receiving the terminal end therein.

In a typical construction, the power tool 20 may include an actuating mechanism 48 for operating the grinding wheel 34. The actuating mechanism may be, for example, a clutch for engaging the grinding wheel and an already-operating motor 32 or a switch for initiating operation of the motor, the operating element in that case already being engaged with the motor. In either such instance, a linkage 50 connects the trigger 30 and the actuating mechanism.

A housing or guard 52 is provided on the power tool 20 for protection of the operating element as well as to protect the operator from the operating element. A passive handle 54 is fixed to the housing 52 at a location distant from the operating handle 24 to aid in manipulation of the power tool by the operator.

Consider a typical operation of the power tool 20 with the operating handle system 22 where the operating element 34 is a grinding wheel. In such a typical operation, the grinding wheel is intended to grind, successively, the top 56 of a rail 58 of a railroad track and the web 60 near the foot of the rail. When so doing, the operator can hold the first course 26 of the operating handle 24 and manipulate the first portion 36 of the trigger to operate the grinding wheel 34 to grind the top of the rail. Alternatively, the operator can hold the second course 28 of the operating handle and manipulate the second portion 38 of the trigger to operate the grinding wheel to grind the web near the foot of the rail.

While preferred embodiments of the invention have been disclosed in detail, it should be understood by those skilled in the art that various other modifications may be made to the illustrated embodiments without departing from the scope of the invention as described in the specification and defined in the appended claims. For example, it would be within the purview of the invention for the operating handle system 22 to be so configured that it power tool 20 could be operated at an intermediate orientation between those illustrated in FIGS. 3 and 4, respectively, for example, at a 45° angle relative to a level position.

What is claimed is:

1. An operating handle system for a hand-held power tool comprising:

an operating handle including a first course for gripping said operating handle in a first orientation and a second course for gripping said operating handle in a second orientation, said operating handle being generally U-shaped and including a third course projecting from said second course at a location distant from said first course and being generally parallel to said first course;

a trigger movably attached to said operating handle for movement between an operative position for energizing a motor for driving an operating element and an inoperative position at which the motor is de-energized, said trigger being elongated and including a first portion associated with said first course and spaced therefrom when said trigger is in the inoperative position and contiguous therewith when said trigger is in the operative position and including a second portion associated with said second course and spaced therefrom when said trigger is in the inoperative position and contiguous therewith when said trigger is in the operative position; and means pivotally attaching said trigger to said operating handle such that when said trigger is in the inoperative position, said first portion and said first course are angularly disposed and said second portion and said second course are angularly disposed, and such that when said trigger is in the operative position, said first portion and said first course are contiguous with one another, and said second portion and said second course are contiguous with one another, said trigger extending to a terminal end distant from said pivotally attaching means, said third course having a cavity formed therein for freely receiving said terminal end therein.

2. An operating handle system as set forth in claim 1 wherein said first course is substantially perpendicular to said second course; and wherein said first portion is substantially perpendicular to said second portion.

* * * * *